US012565815B2

(12) United States Patent
Dos Reis et al.

(10) Patent No.: US 12,565,815 B2
(45) Date of Patent: Mar. 3, 2026

(54) DIVERLESS UNIFIED SUPPORT TUBE

(71) Applicant: PETRÓLEO BRASILEIRO S.A.—PETROBRAS, Rio de Janeiro (BR)

(72) Inventors: Bruno Pinho Dos Reis, Rio de Janeiro (BR); Jorge Gomes de Melo Medeiros, Rio de Janeiro (BR); Gilnei Reckziegel, Rio de Janeiro (BR); Roberto Pereira Ferreira, Rio de Janeiro (BR); Raphael Moreira De Brito, Rio de Janeiro (BR); Claudio Violante Ferreira, Rio de Janeiro (BR); Flavio Barroso De Mello, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 10 days.

(21) Appl. No.: 18/682,876

(22) PCT Filed: Aug. 31, 2022

(86) PCT No.: PCT/BR2022/050345

§ 371 (c)(1),
(2) Date: Feb. 9, 2024

(87) PCT Pub. No.: WO2023/028680

PCT Pub. Date: Mar. 9, 2023

(65) Prior Publication Data

US 2025/0230717 A1 Jul. 17, 2025

(30) Foreign Application Priority Data

Aug. 31, 2021 (BR) ..... 10 2021 017344 0

(51) Int. Cl.
*E21B 19/00* (2006.01)

(52) U.S. Cl.
CPC ..... *E21B 19/004* (2013.01)

(58) Field of Classification Search
CPC ..... E21B 19/004
See application file for complete search history.

(56) References Cited

U.S. PATENT DOCUMENTS 5,947,642 A 9/1999 Teixeira et al.
6,536,527 B2 * 3/2003 Munk ..... E21B 43/0107 166/341

(Continued)

FOREIGN PATENT DOCUMENTS

BR 102018011452 A2 12/2019
BR 102020010231 A2 11/2021

(Continued)

OTHER PUBLICATIONS

English translation of the International Search Report dated Dec. 15, 2022, in connection with Int'l Appln No. PCT/BR2022/050345 (3 pages).

*Primary Examiner* — Matthew R Buck
(74) *Attorney, Agent, or Firm* — McCarter & English, LLP

(57) ABSTRACT

A riser support is disclosed that is completely integrated into the Riser Balcony of a Floating Production Storage and Offloading (FPSO), which serves both rigid and flexible risers. This riser support presents a versatility that allows the use of flexible or rigid risers with some variation in their inner diameters and the interconnection can be carried out on the port or starboard side. The Diverless Unified Support Tube (DUST) is characterized in that it comprises an upper cone, a guide tube and a centralizer, responsible for centralizing the hang-off adapter and locking the bend stiffener. The application of DUST can promote a reduction in the length of rigid pipes in the subsea arrangement by allowing keel-hauling interconnections, in addition to enabling the opti- (Continued)

mization of the rigid riser interconnection operation and accelerating the Ramp-up of new SPUS.

22 Claims, 12 Drawing Sheets

(56) References Cited

U.S. PATENT DOCUMENTS

| | | | | |
|---|---|---|---|---|
| 8,931,807 | B2 * | 1/2015 | Taylor | F16L 37/23 285/308 |
| 10,597,952 | B2 | 3/2020 | Otten et al. | |
| 11,773,661 | B2 * | 10/2023 | Simões | E21B 17/015 166/352 |
| 2007/0056741 | A1 | 3/2007 | Finn et al. | |
| 2008/0087435 | A1 * | 4/2008 | Reddy | E21B 17/085 166/343 |
| 2015/0337607 | A1 * | 11/2015 | Latimer | E21B 19/004 166/345 |
| 2018/0313172 | A1 * | 11/2018 | Smits | E21B 19/004 |
| 2021/0348449 | A1 | 11/2021 | Pinho Dos Reis et al. | |
| 2023/0228159 | A1 | 7/2023 | Violante Ferreira et al. | |

FOREIGN PATENT DOCUMENTS

| | | | |
|---|---|---|---|
| WO | 2017/034409 | A1 | 3/2017 |
| WO | 2019/232605 | A1 | 12/2019 |
| WO | 2021/048592 | A1 | 3/2021 |

* cited by examiner

DIVERLESS UNIFIED SUPPORT TUBE

RELATED APPLICATIONS

The present application is a U.S. National Phase Application under 35 U.S.C. $371 of International Application No. PCT/BR2022/050345 filed on Aug. 31, 2022, which claims the benefit of Brazilian Patent Application No. BR 10 2021 017344 0 filed on Aug. 31, 2021, the entire disclosures of which are expressly incorporated by reference herein.

FIELD OF THE INVENTION

The present invention is based on the development of a solution for supporting rigid and flexible risers.

DESCRIPTION OF THE STATE OF THE ART

The development of the production in the Pre-Salt has been carried out using rigid risers and riser support concepts that allow the definition of both technologies in the same FPSO, such as, for example, the double balcony.

The possibility serial manufacturing of replicating FPSO hulls for the Pre-Salt pole highlighted the need to make the riser support systems suitable for an operational condition that still has uncertainties. The generalization of the structural and operational context, in order to allow a SPU to be manufactured even before the complete definition of the background arrangement of a production field, led to the development by Petrobras of the Multifunctional Bellmouth-MB.

The base concept established for this new riser support device was that the MB aimed, among other characteristics, at the versatility of allowing the use of flexible or rigid risers with some variation in their inner diameters, and that the interconnection could be carried out on the port or starboard side of the SPU. An overview of the MB and its main components is represented in FIG. 1. The interface of the MB with the top termination of the riser depends on the technology adopted (rigid or flexible riser), wherein the locking of the rigid risers is carried out by the upper part, and that of the flexible risers by the lower part.

In the case of supporting flexible risers, the bend stiffener is locked using the same bellmouth concept as the BSN300 series (US005947642A), wherein the bend stiffener helmet is locked by dogs (FIG. 2) and the riser traction anchored by the hang-off on the upper balcony of the FPSO.

In the case of supporting rigid risers, a new concept was developed (FIG. 3), in which the MB can be considered as a first approach of Support Tube, where the top termination of the riser, commonly called "hang-off adapter", contains a flexible joint or stress joint coupled to its lower part. The traction of the riser is anchored in the upper cone of the MB, this effort being transmitted by wedges that, in the initial development stage of the MB concept, would be installed by shallow diving. The lateral forces arising from the riser would be supported by the locking ring, also highlighted in FIG. 3.

During the detailing of the hang-off adapter for the FPSO Cidade de Ilhabela, some difficulties were observed in the design that were not identified during the conceptual phase of development of the MB. The first prohibitive issue, requiring modification of the design, was the realization that, for safety reasons, the diver could not install the wedges, as his hand would be positioned between the MB and the riser tensioned by the pull-in cable, situation considered to be of unacceptable risk.

The solution found for this problem was the development of articulated wedges for the FPSO Cidade de Ilhabela (WO2017/034409 A1). However, this solution cannot be effectively applied to replicating FPSOs, as this device has dimensions that are incompatible with the riser support balcony of the replicants, which has a very restricted space for installing the MB. In addition, the device may require considerable diving activity for its operation; in particular, for the pull-out procedures.

Another important point, observed during the interconnection of rigid risers to the FPSO Cidade de Ilhabela, was that the compensator gap system (FIG. 4), which corresponds to the "locking ring" in the original MB concept (FIG. 3), despite being able to perform the lateral locking of the hang-off adapter, thus allowing the transmission of the shear force from the riser, does not guarantee the complete suppression of the misalignment of the riser installation, n depends on diving operation.

Based on the disclosure above, it is observed that the Support Tube concept (MB or support tube of the FPSO Cidade de Ilhabela), although viable and with some advantages for the pull-in operation (such as, for example, not requiring of auxiliary cables to allow the installation), brings complexities to the rigid riser support system. As a result, it was decided that the receptacle-type support should be the standard for interconnecting rigid risers due to its simplicity.

Subsequently, with the aim of promoting competitiveness between rigid and d flexible risers, the double balcony concept was adopted, in which the first layer consists of a bellmouth to support flexible risers and in the second layer there is the receptacle for the rigid risers, as disclosed in FIG. 5.

The pattern shown in FIG. 5 presented difficulties as to implementation when the need for a large number of keelhauling interconnections in certain SPUs was identified. In the case of the interconnection of flexible risers, the Bellmouth solution is quite independent of the direction of the riser, whether by direct boarding or by keelhauling. However, for rigid risers, the standard receptacle support solution would require a large balcony on the upper riser balcony to enable the pull-in process (FIG. 6), which was assessed as incompatible for application in new FPSOs designs.

The Riser Modular Support Tube (RMoST) (FIG. 7) was developed as the Minimum Viable Product (MVP) to enable the interconnection of rigid risers by keelhauling, with a minimum impact on the design of an FPSO, comprising a double flanged tube—guide tube. At each of the flanged ends, equipment suitable for supporting the rigid riser must be connected, a concept that defines its modular character. On the upper flange, a device called Upper Cone is connected, comprising a system of sliding wedges to lock the top termination of the riser and subsequently support the tensile load of the riser (BR 10 2020 010231-1). On the lower flange, a device called centralizer is connected, which is responsible for lateral locking, presenting a function corresponding to the locking ring of the MB concept (see FIG. 3) and the consequent stabilization of the top termination of the riser.

The biggest limitation identified in the use of RMoST is that this is a support dedicated only to the interconnection of rigid risers. The use of a double layer including bellmouth and RMoST, similar to the concept presented in FIG. 5, was considered unfeasible due to incompatibility of requirements for these two types of dedicated supports. Due to flexible riser support requirements in Bellmouths, the RMoST would need to be located on the external layer, as for the Receptacle indicated in FIG. 5, which would also lead to a large balcony on the Upper riser balcony to perform pull-in on the RMoST.

This limitation indicated the need to develop a new hybrid support (rigid and flexible risers) for future SPUs. In addition to the need of making riser technology more flexible, there is also the objective of increasing the level of safety in underwater operations, removing the diver as much as possible from highly dangerous tasks, also allowing riser interconnection operations in more adverse meteoceanographic conditions, increasing the productivity of vessels installing risers by eliminating simultaneous operations with shallow diving. These motivations led to the development of the Diverless Unified Support Tube—DUST—whose solution, the focus of this invention, will be described below.

Document WO2019232605A1 discloses a coupling system between a bend stiffener and a bellmouth comprising a plurality of locking mechanisms, where each locking mechanism is fixed externally to the bellmouth, further containing a movable lug downwardly inclined positioned, wherein the lug accesses the interior of the bellmouth and is activated by an elastic element adapted to exert pressure on the lug towards the interior of the bellmouth. Furthermore, the locking mechanism comprises a reaction block (35) in which the elastic element (34) is seated.

Document WO2021048592A1 discloses a rigid riser support having locking mechanisms, comprising one or more lug portions protruding into an inner surface of the annular sidewall and adapted to cooperate with corresponding hook portions formed on an outer surface of the coupling adapter so as to produce a shaped coupling between the lug portions and the hook portions. In addition, the support also presents a structure similar to a "spool".

Document US20070056741A1 discloses a support for a Steel Catenary Riser (SCR) on a floating structure, comprising a receptacle connected to the floating structure; a flexible support tube that surrounds the SCR and is sized to support the SCR while allowing the SCR to bend; a pivot mechanism on the support tube that secures the support tube to the receptacle, in order to allow the rotation of the support tube relative to the floating structure. In addition, the pivot mechanism includes a locking mechanism that is selectively operated to lock the pivot mechanism within the receptacle.

The presented documents of prior art do not provide a riser support device capable of being versatile and allowing the use of flexible and/or rigid risers with varying inner diameters.

In face of the difficulties present in the abovementioned State of the Art, for flexible and/or rigid riser support solutions, there is a need of developing a technology capable of presenting effective performance and that is in accordance with environmental and safety guidelines. The abovementioned State of the Art does not have the unique features of the present invention, which will be presented in detail below.

OBJECTIVE OF THE INVENTION

It is an objective of the invention to provide a riser support device capable of being versatile and allowing the use of flexible and/or rigid risers with varying inner diameters.

BRIEF DESCRIPTION OF THE INVENTION

The present invention presents a support for risers, completely integrated with the FPSO Riser Balcony, which serves both rigid and flexible risers.

The base concept established for this new riser support system presents a versatility that allows the use of flexible and/or rigid risers with some variation in their inner diameters and that the interconnection can be carried out on the port or starboard side of the SPU.

In general, the Diverless Unified Support Tube (DUST) (FIG. 8) is provided with an upper cone (1), a guide tube (2) and a centralizer (3).

BRIEF DESCRIPTION OF THE DRAWINGS

The present invention will be described in more detail below, with reference to the attached figures that, in a schematic way and not limiting the inventive scope, represent examples of its embodiment. In the drawings, there are.

DETAILED DESCRIPTION OF THE INVENTION

There follows below a detailed description of a preferred embodiment of the present invention, which is exemplary and in no way limiting. However, it will be clear to a technician skilled on the subject, upon reading the description, possible additional embodiments of the present invention still comprised by its essential and optional features.

Figure 1:
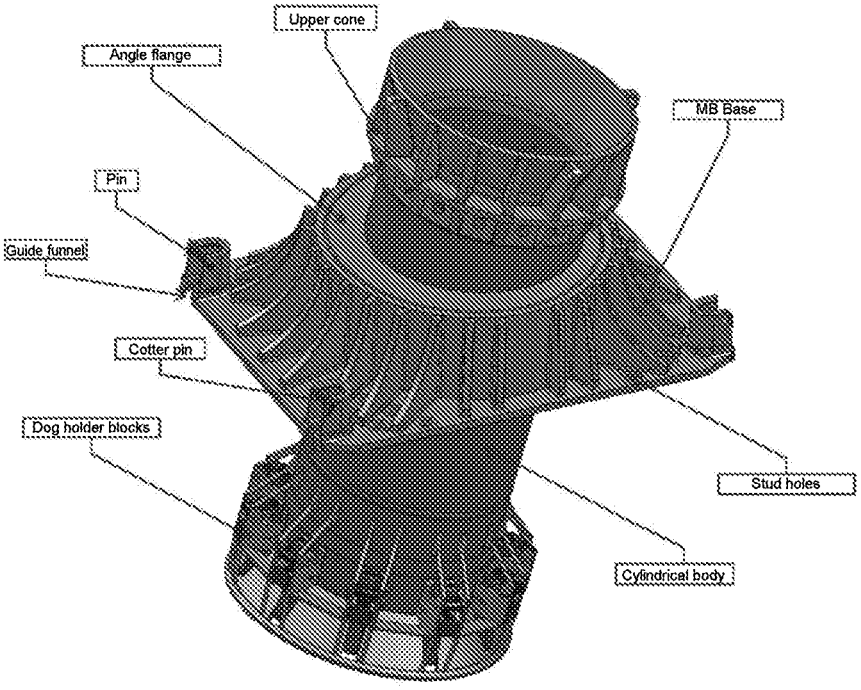
FIG. 1 illustrating the overview of the MB, as known in the State of the Art.
Figure 2:
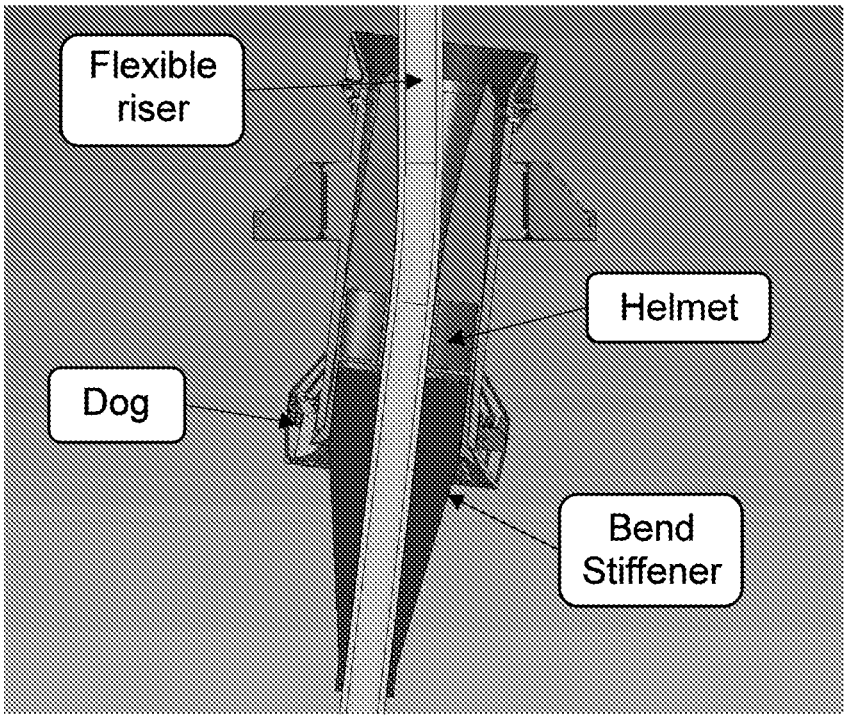
FIG. 2 illustrating the support of flexible risers in MB, as known in the State of the Art.
Figure 3:
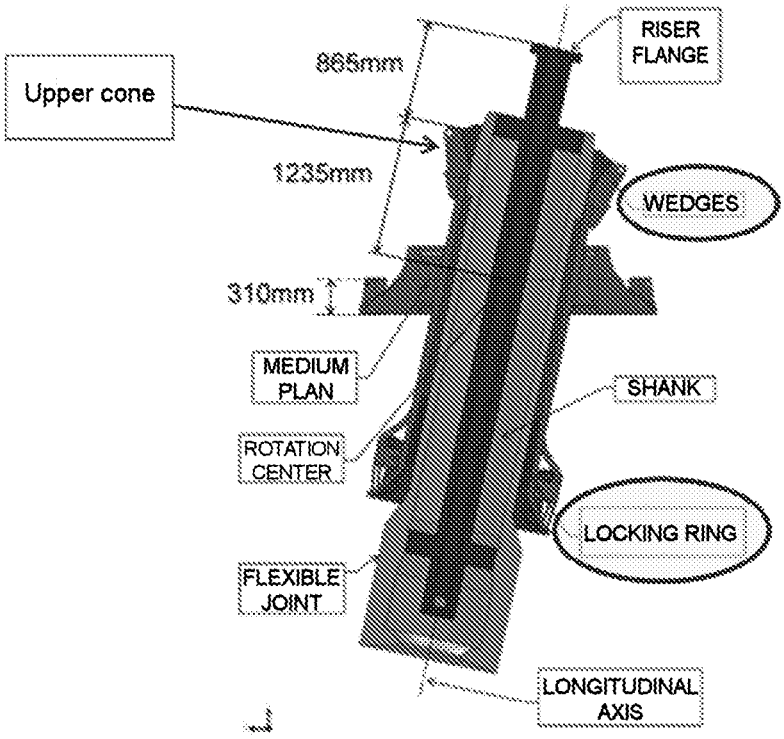
FIG. 3 illustrating the preliminary concept of supporting rigid risers in MB, as known in the State of the Art.
Figure 4:
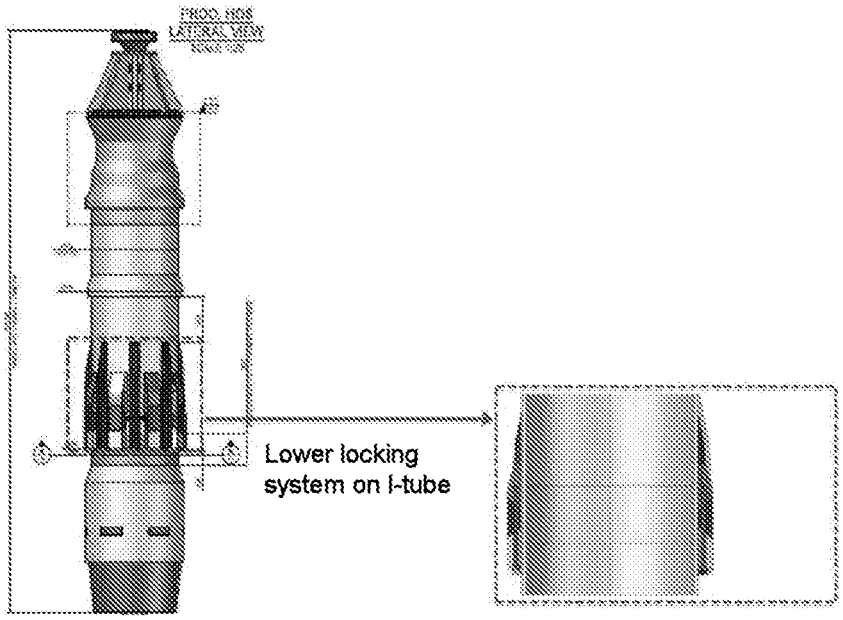
FIG. 4 illustrating the gap compensator-gap eliminator of the hang-off adapter to the FPSO Cidade de Ilhabela.
Figure 5:
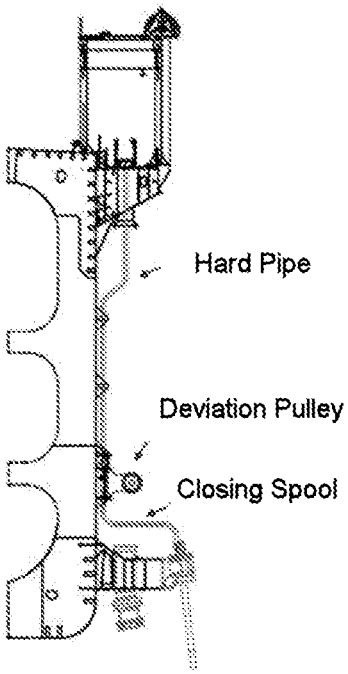
FIG. 5 illustrating the double balcony concept adopted as standard at Petrobras.
Figure 6:
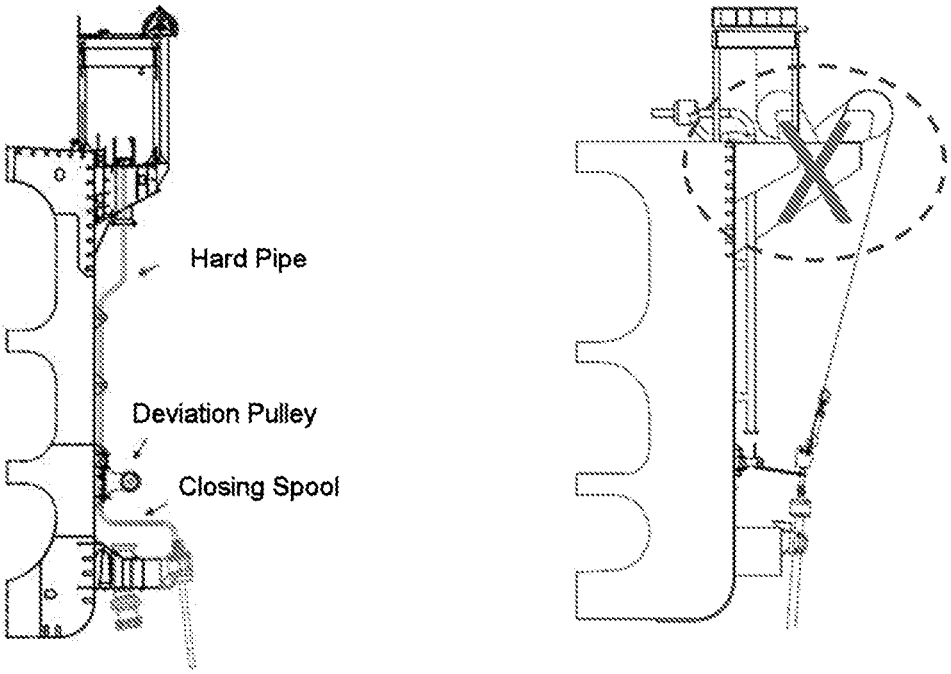
FIG. 6 illustrating the initially proposed riser support system. On the left, double balcony considering Bellmouth and Receptacle, and on the right, rigid riser interconnection by keelhauling, which requires a large balcony for the pull-in system.
Figure 7:
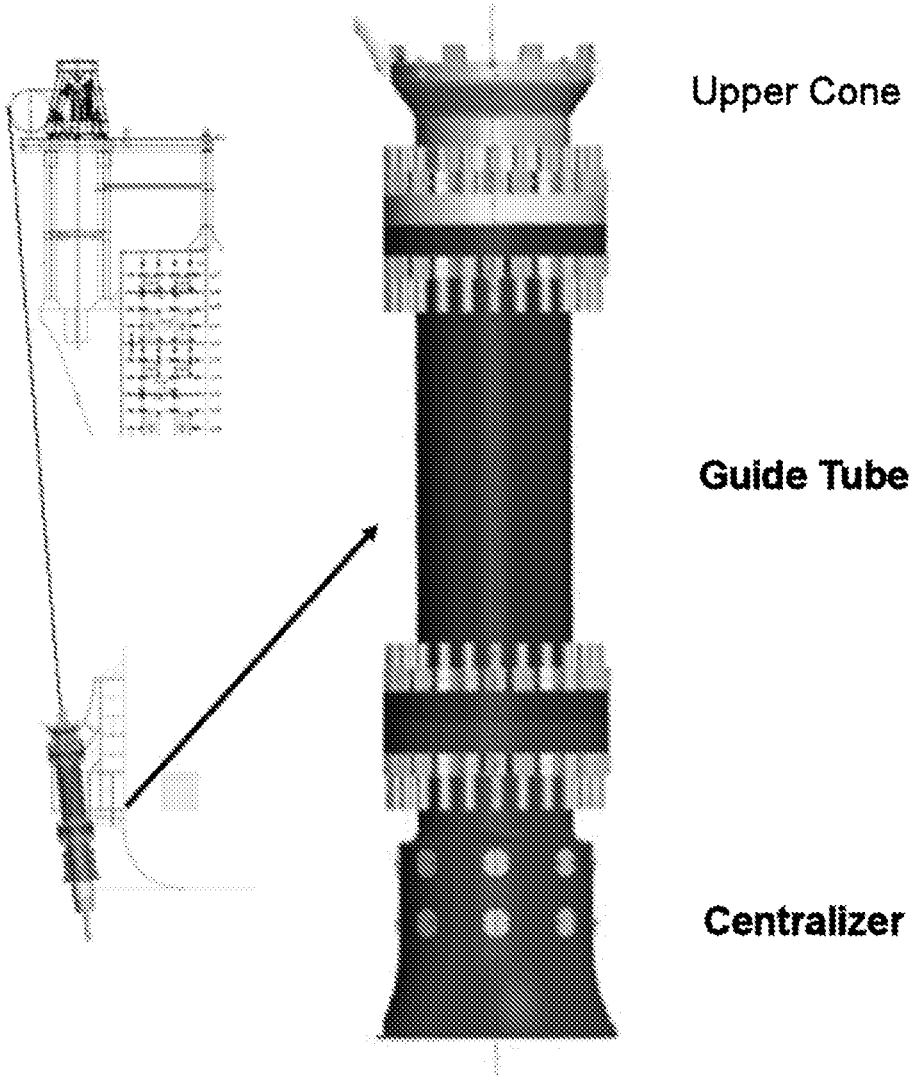
FIG. 7 illustrating an overview of RMoST.
Figure 8:
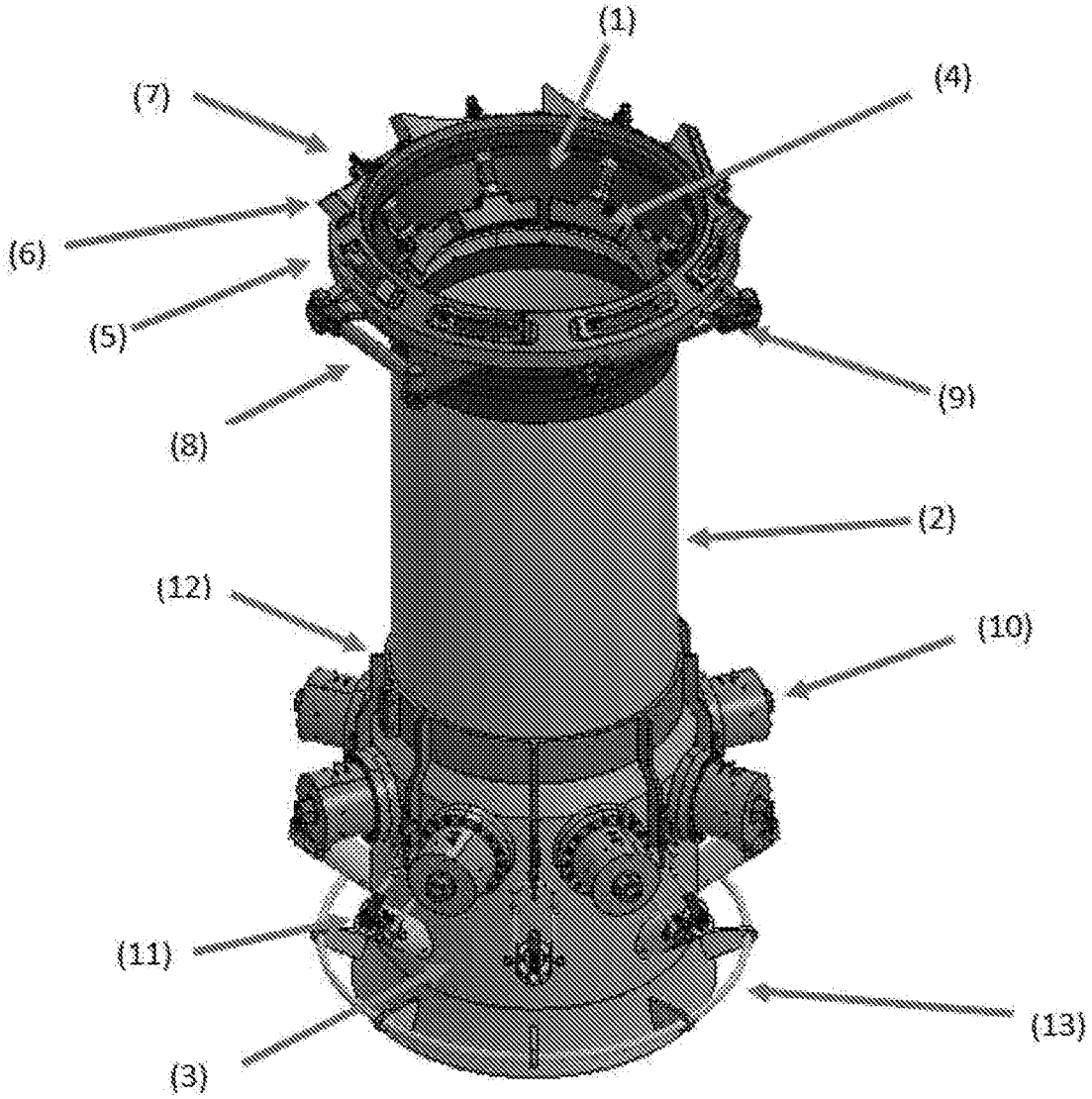
FIG. 8 illustrating an overview of DUST.

FIG. 8 shows an overview of the Diverless Unified Support Tube (DUST). As with the RMoST, the DUST can be separated into three macro components: the upper cone (1), responsible for supporting the rigid riser, the guide tube (2), responsible for promoting the integration with the FPSO riser balcony (see FIG. 9), and a centralizer (3), responsible for centralizing the hang-off adapter in supporting the rigid riser, through the LLM (10), and for containing the bend stiffener locking system (11).

Figure 9:
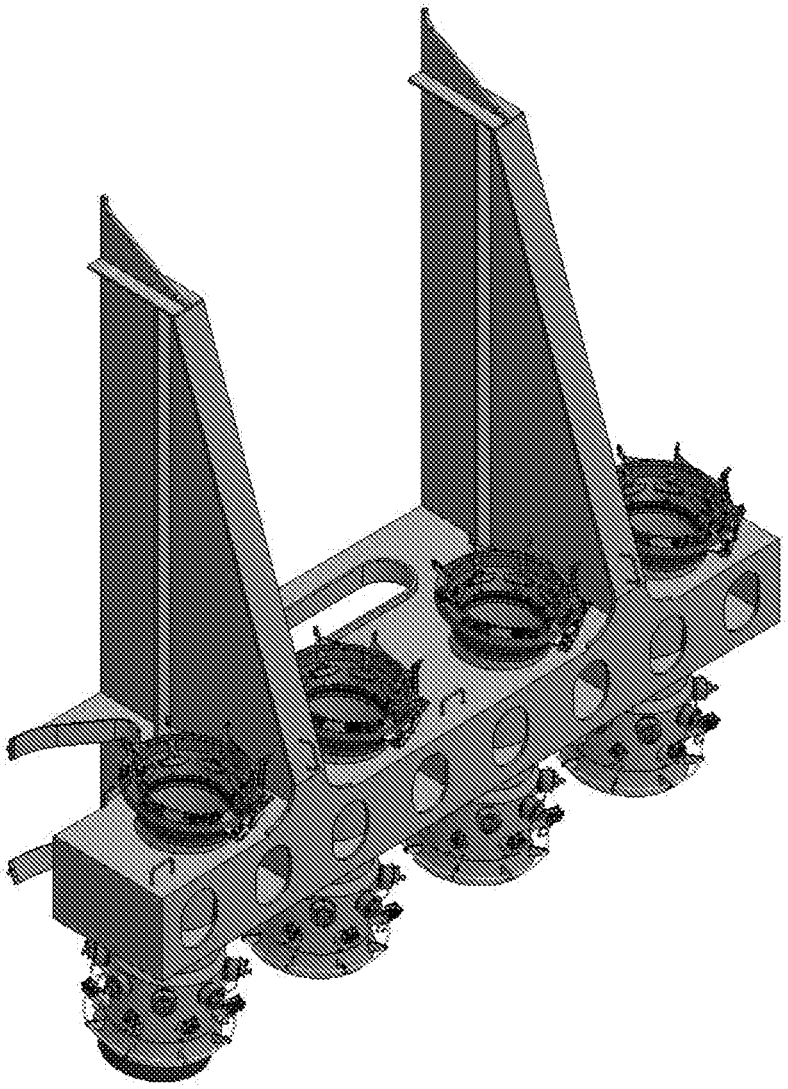
FIG. 9 illustrating the DUST integrated into the Lower Riser Balcony.
Figure 10:
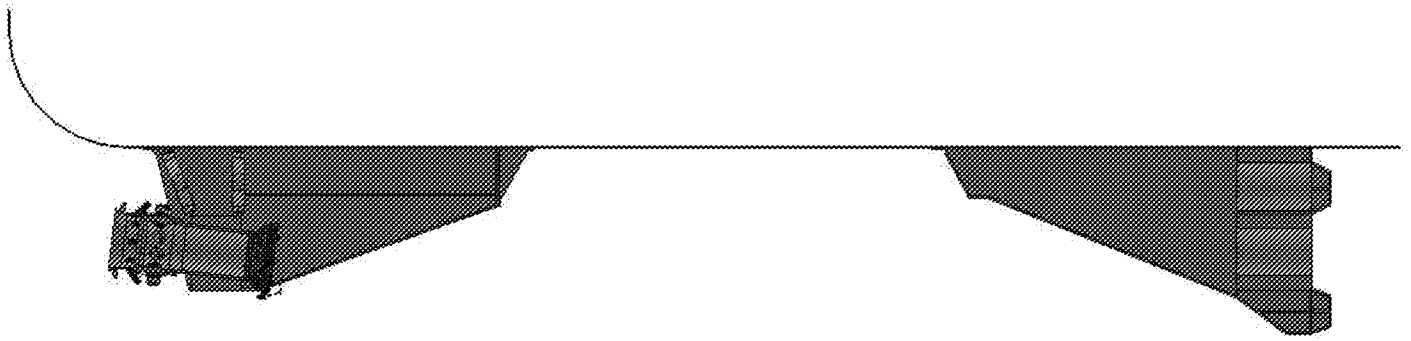
FIG. 10 illustrating a sectional view of the DUST and its configuration in relation to the FPSO side.

As previously mentioned, DUST was developed as a single solution completely integrated into the FPSO Riser Balcony design (FIG. 9 and FIG. 10). This led to a large reduction in the total length of the DUST in relation to the RMoST, with a similar order of magnitude to that of the MB, which allowed a compatibility with the support requirements of flexible risers.

To support rigid risers, the upper cone initially designed for the RMoST was improved, making it automated, and the centralizer system (3) was improved by the inclusion of Lateral Locking Modules—LLM (10), hydraulics systems that stabilize the lateral forces of the rigid riser. To support flexible risers, DUST considered an adaptation of the Diverless Bellmouth—MB (BR 10 2018 011452-2), considering the use of its bend stiffener locking system (11). Further details of each of the components of the invention will be presented below.

According to the initial concept established by the MB, the DUST considers two macro components for supporting a rigid riser: an upper cone (1) and its subcomponents for supporting the traction of the riser, and a Lateral Locking Module—LLM (10) to provide lateral locking of the riser.

With main elements similar to the upper cone of the RMoST, the upper cone (1) of the DUST was improved mainly in the automation of the system and consequent reduction in the need for human intervention; that is, making the upper cone (1) a diverless device.

Figure 11:
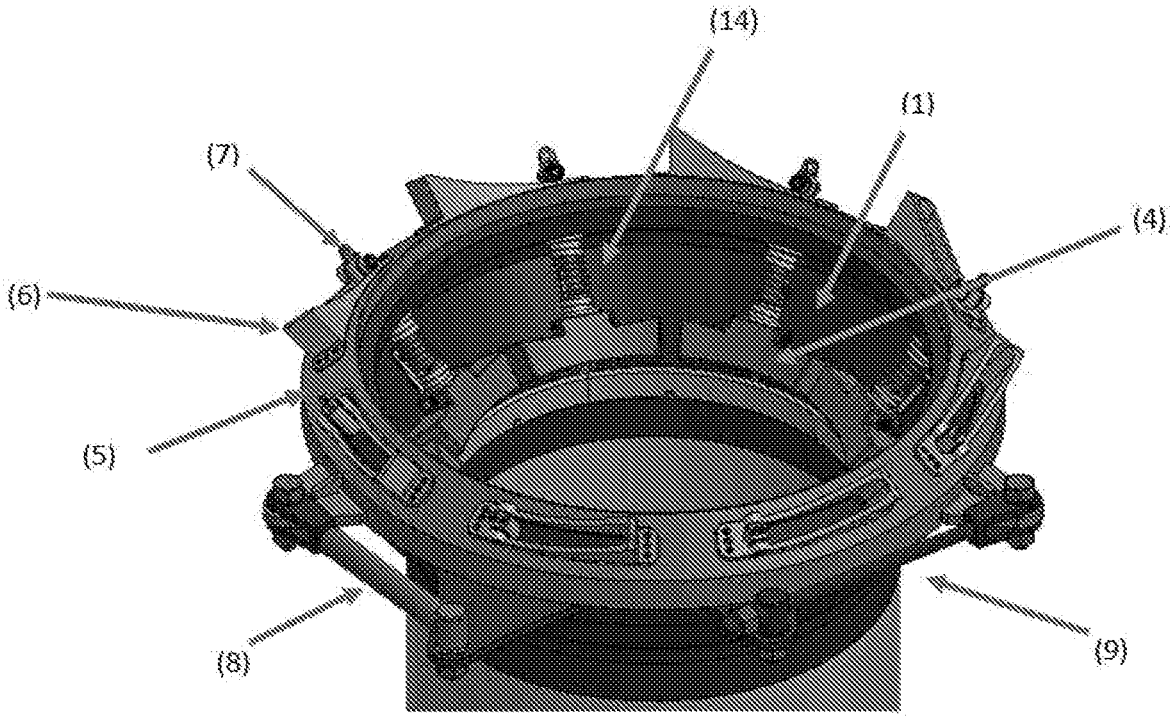
FIG. 11 illustrating the upper cone of the DUST.
Figure 12:
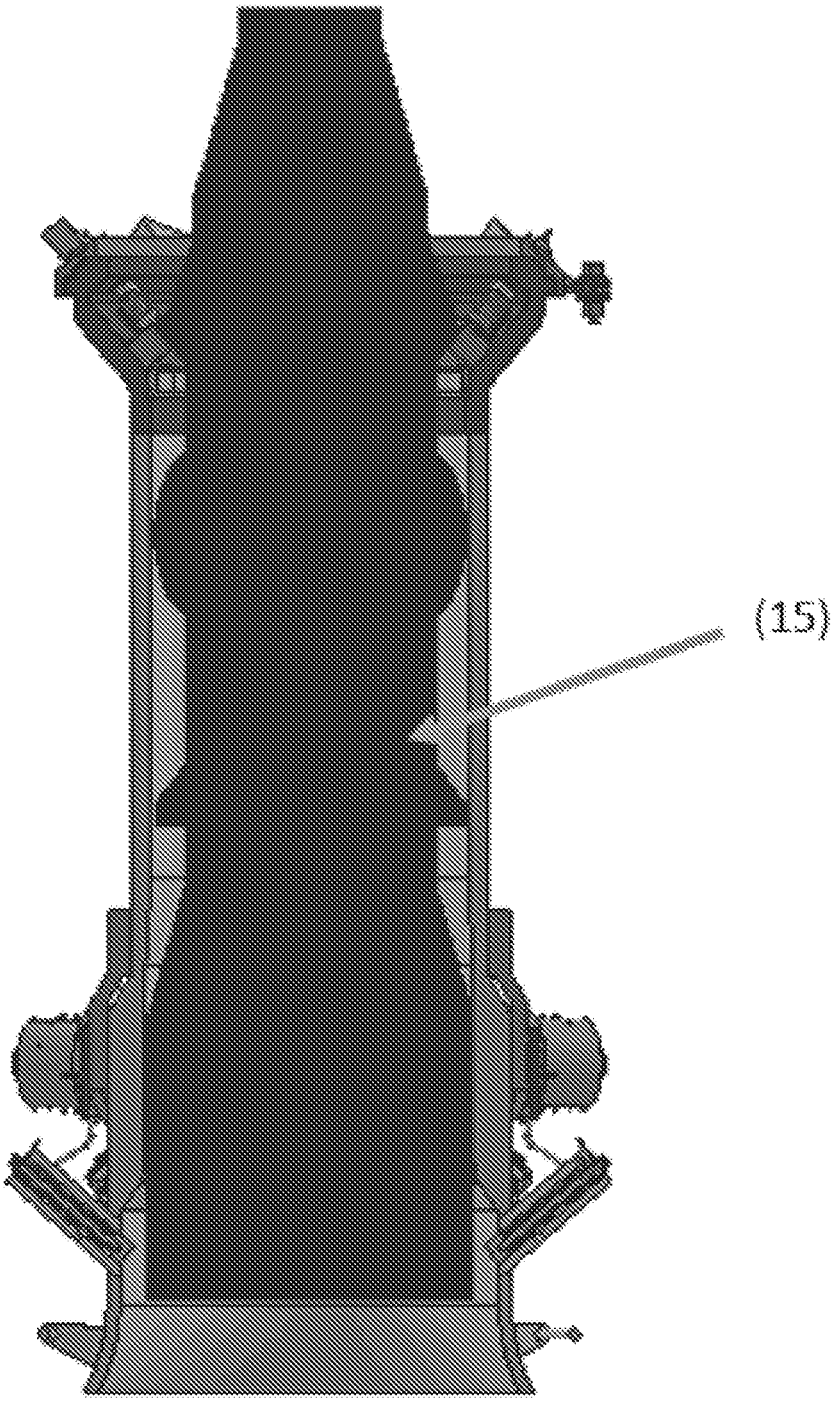
FIG. 12 illustrating an overview of the top termination of the rigid riser coupled to DUST.

A better view of the Upper Cone (1) is shown in FIG. 11. The effective support of the riser traction is carried out by wedges (4). During the pull-in operation, the top termination of the riser (15) makes contact with the wedges (4) in its lower part, and these slide through the upper cone (1) in an upward movement guided by rods (7), returning to its working position due to the effect of gravity and the force of springs (14). With the subsequent seating of the top termination of the riser (15) on the wedges (4), the riser traction support is completed (FIG. 12).

Figure 13:
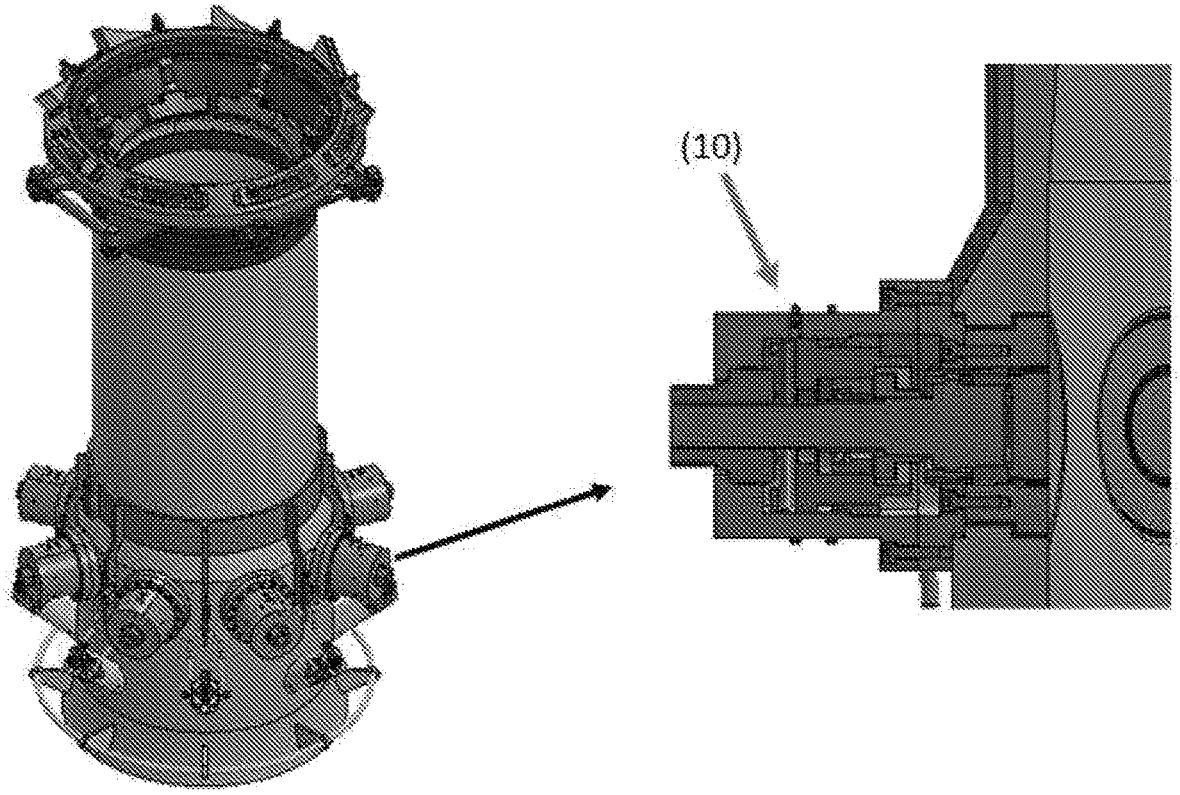
FIG. 13 illustrating a detail of the Lateral Locking Module (LLM)

With the operation described in paragraph 0032, although the riser traction is secure, the top termination of the riser (15) is supported in an unstable manner, and dynamic movements of the FPSO would cause a relative movement between the riser and the DUST. For lateral stabilization, a series of lateral locking modules (10) are actuated hydraulically, or by ROV/diver to eliminate gap with the top termination of the riser (15), thus securely supporting the riser. The LLM (10) (FIG. 13) consists of a conical mandrel that, when advancing towards the center of the DUST, compresses four shoes against the outer ring, resulting in the assembly locking in any position on the approach course, regardless of hydraulic pressure.

In a pull-out operation, the cam holder crown (5) is rotated on its axis coinciding with the upper cone (1). This movement is primarily carried out by the hydraulic actuator (8), a component resident in the DUST design, or alternatively by the ROV actuator (9), a tool that can be installed by the ROV in case of failure of the first actuation method, or by any other difficulty. As the cam holder crown (5) rotates, the cams (6) promote the pulling action of the rod (7), thus retracting the wedges (4) and allowing the removal of the top termination of the riser (15).

It is further: important to highlight that the operation described in paragraph 0034 can also bring gains to pull-in operations, as it allows the prior functioning test of the automatic wedge sliding mechanism (4) to be carried out through direct contact with the top termination of the riser (15), ensuring that there is no impediment to the sliding of the components, such as, for example the presence of scales. Alternatively, this same mechanism can replace the primary actuation in the automatic mechanism pull-in; that is, the hydraulic system (8) can act so that the wedges (4) are previously retracted, avoiding any contact with the top termination of the riser (15) during the pull-in operation.

Returning to the pull-out operation, in case of failure of actuation of the cam holder crown (5), each of the rods (7) contains an eyelet in its posterior position so that the wedges (4) are retracted separately.

With the previous concept of dogs adopted at MB, it is observed that shallow diving was involved in all stages of the pull-in operation. However, the most critical step is the moment of coupling the bend stiffener to the bellmouth, as it acts in parallel with the PLSV. The limit environmental conditions for PLSV are considerably greater when compared to the limit for shallow diving. And as the environmental conditions in the Pre-Salt locations are more severe, there is a considerable Non-Productive Time (NPT) of the PLSV in favorable conditions to launch the flexible pipe, but not to allow the operation of supporting the shallow dive.

The concept developed in this invention, for the support of flexible risers, is similar to the MB concept (BR 10 2018 011452-2), where it was identified that new bellmouth designs should not significantly change the pull-in procedures adopted at Petrobras.

Figure 14:
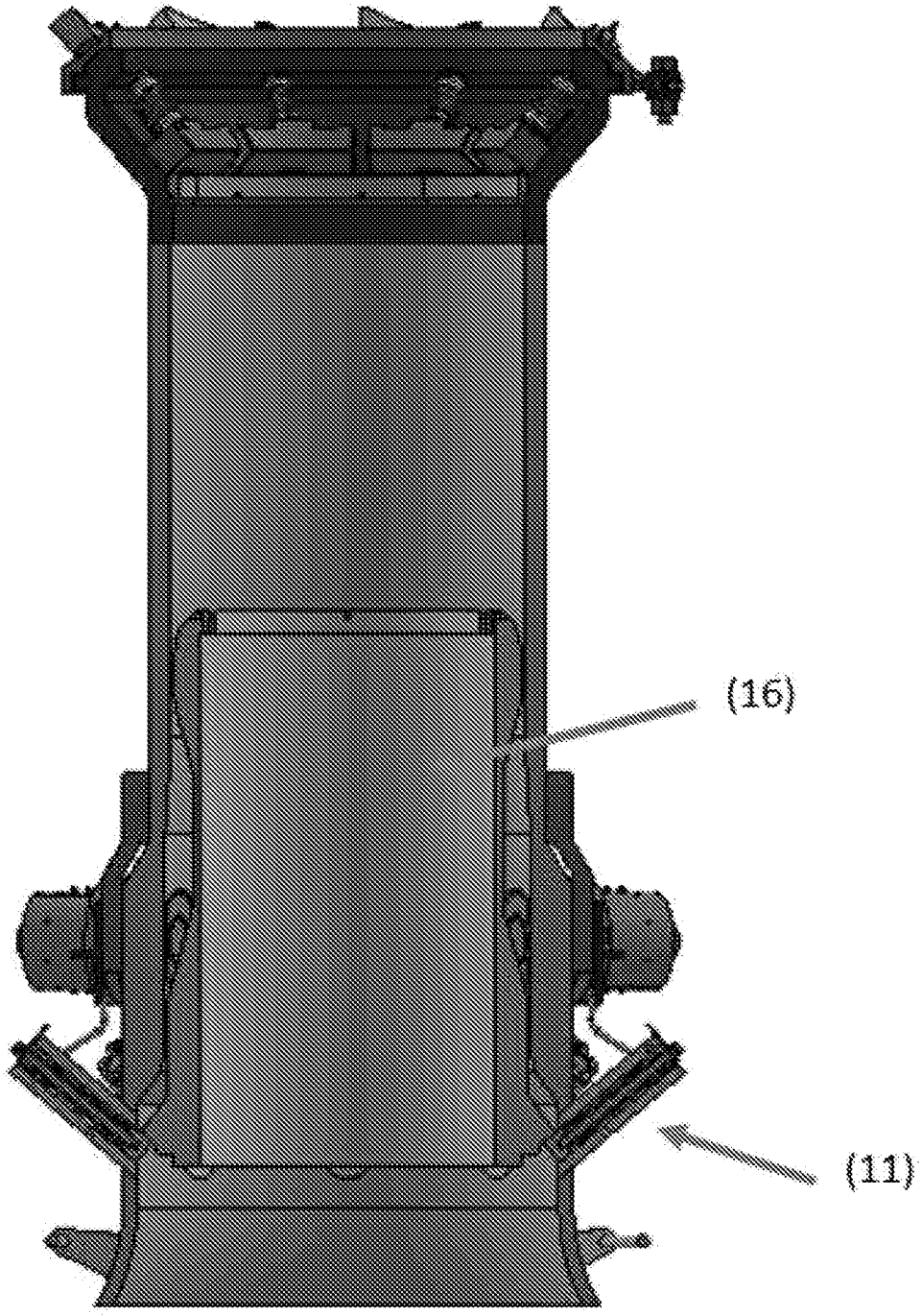
FIG. 14 illustrating the flexible riser helmet supported by the DUST.

The concept of locking the bend stiffener is quite similar to previous bellmouth designs. The main changes to this invention were the definition of an optimized connection geometry and a more efficient locking system, with both innovations having the objective of reducing the loads associated with the process of connecting the bend stiffener to the bellmouth and reducing the activities of dive. The support of a bend stiffener helmet (16) in the DUST is represented in FIG. 14.

Figure 15:
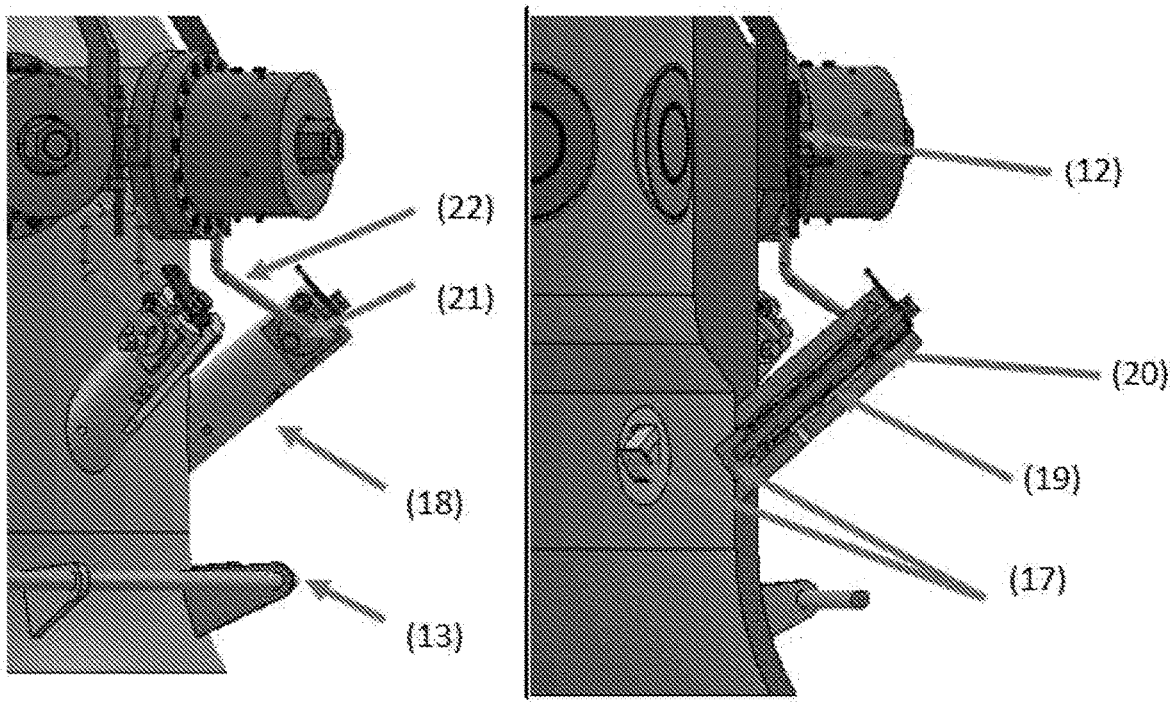
FIG. 15 illustrating the bend stiffener locking system.

The main components of the bend stiffener locking system (11) of the DUST are presented in FIG. 15, with an external view (left) and a sectional view (right) being shown, indicating internal details of the mechanism. The support of the bend stiffener helmet (16) is carried out by lugs (17), wherein these and the entire locking mechanism are confined inside a block called lug holder (18). During the pull-in operation, the lugs (17) retract to pass the helmet (16), and their automatic return to the extended position is carried out by springs (19) accommodated in the reaction block (20).

The significant advantage of this mechanism is that no shallow diving actuation is required to lock the lugs (17) after the end of the pull-in operation, whereas in previous models of bellmouths a manual actuation was required for locking of the dogs.

In pull-out operations, the eccentric mechanism (21) containing a handle (22) can be operated by ROV (or alternatively by shallow diving, in case of difficulties) to retract the lug (17). For this operation, the grab ring (13) provides a fixed point for the ROV to stabilize its movements through one manipulator, while the other acts on the handle (22).

To prevent any unintentional action on the mechanism from resulting in retracting the lugs (17) at an instant prior to the pull-out operation, a clamp (12) having pins prevents the movement of the handle (22), wherein these pins presents an interface suitable for unlocking by ROV (or, alternatively, by shallow diving, in case of difficulties).

The invention claimed is:

1. A DIVERLESS UNIFIED SUPPORT TUBE (DUST), comprising an upper cone, a guide tube, and a centralizer, the upper cone being automated and of a diverless style, the centralizer includes Lateral Locking Modules (LLM) and a bend stiffener locking system, the LLM consists of a conical mandrel that, when advancing towards a center of the DUST, compresses four shoes against an outer ring, resulting in locking of the LLM in any position on the approach course, regardless of hydraulic pressure.

2. THE DIVERLESS UNIFIED SUPPORT TUBE (DUST) according to claim 1, comprising wedges responsible for riser traction support.

3. THE DIVERLESS UNIFIED SUPPORT TUBE (DUST) according to claim 2, wherein a top termination of a riser makes contact with the wedges in a lower part of the top termination, said wedges sliding through the upper cone in an upward movement guided by rods, returning to a working position by the effect of gravity and the force of springs.

4. THE DIVERLESS UNIFIED SUPPORT TUBE (DUST) according to claim 3, wherein a cam holder crown is rotated on an axis coinciding with the upper cone for pull-out operation.

5. THE DIVERLESS UNIFIED SUPPORT TUBE (DUST) according to claim 4, wherein a hydraulic actuator, or an ROV actuator, performs the rotating movement.

6. THE DIVERLESS UNIFIED SUPPORT TUBE (DUST) according to claim 4, wherein the cam holder crown rotates, cams promoting a pulling action of the rods, thus retracting the wedges and allowing the removal of the top termination of the riser.

7. THE DIVERLESS UNIFIED SUPPORT TUBE (DUST) according to claim 6, wherein each of the rods contains an eyelet in a posterior position so that the wedges are retracted separately, in the event of actuation failure of the cam holder crown.

8. THE DIVERLESS UNIFIED SUPPORT TUBE (DUST) according to claim 3, wherein an automatic sliding mechanism of the wedges can replace-a primary actuation in an automatic mechanism pull-in of a hydraulic system and ensure that the wedges are previously retracted, avoiding any contact with the top termination of the riser during the pull-in operation.

9. THE DIVERLESS UNIFIED SUPPORT TUBE (DUST) according to claim 1, wherein the support of a bend stiffener helmet is carried out by lugs wherein said lugs and the bend stiffener locking system are confined within a block called a lug holder.

10. THE DIVERLESS UNIFIED SUPPORT TUBE (DUST) according to claim 9, wherein the lugs retract to pass the helmet and automatically return to an extended position by springs accommodated in a reaction block.

11. THE DIVERLESS UNIFIED SUPPORT TUBE (DUST) according to claim 9, wherein an eccentric mechanism containing a handle can be operated by ROV to retract the lug.

12. THE DIVERLESS UNIFIED SUPPORT TUBE (DUST) according to claim 11, wherein a grab ring provides a fixed point for an ROV to stabilize movements of the ROV through one manipulator, while the other acts on the handle.

13. THE DIVERLESS UNIFIED SUPPORT TUBE (DUST) according to claim 11, wherein a clamp having pins prevents the movement of the handle, avoiding any unintentional action on the mechanism, acting in order to retract the lugs.

14. A DIVERLESS UNIFIED SUPPORT TUBE (DUST), comprising an upper cone, a guide tube, wedges responsible for riser traction support, and a centralizer, the upper cone being automated and of a diverless style, wherein a top termination of a riser makes contact with the wedges in a lower part of the top termination, said wedges sliding through the upper cone in an upward movement guided by rods, returning to a working position by the effect of gravity and the force of springs.

15. THE DIVERLESS UNIFIED SUPPORT TUBE (DUST) according to claim 14, wherein a cam holder crown is rotated on an axis coinciding with the upper cone for pull-out operation, and a hydraulic actuator, or an ROV actuator, performs the rotating movement.

16. THE DIVERLESS UNIFIED SUPPORT TUBE (DUST) according to claim 6, wherein the cam holder crown rotates, cams promoting a pulling action of the rods, thus retracting the wedges and allowing the removal of the top termination of the riser.

17. THE DIVERLESS UNIFIED SUPPORT TUBE (DUST) according to claim 16, wherein each of the rods contains an eyelet in its a posterior position so that the wedges are retracted separately, in the event of actuation failure of the cam holder crown.

18. A DIVERLESS UNIFIED SUPPORT TUBE (DUST), comprising an upper cone, a guide tube, wedges responsible for riser traction support and a centralizer, the upper cone being automated and of a diverless style, wherein a top termination of a riser makes contact with the wedges in a lower part of the top termination, and wherein a cam holder crown is rotated on an axis coinciding with the upper cone for pull-out operation.

19. THE DIVERLESS UNIFIED SUPPORT TUBE (DUST) according to claim 18, wherein a hydraulic actuator, or an ROV actuator, performs the rotating movement.

20. THE DIVERLESS UNIFIED SUPPORT TUBE (DUST) according to claim 18, wherein the cam holder crown rotates, cams promoting a pulling action of rods, thus retracting the wedges and allowing the removal of the top termination of the riser.

21. THE DIVERLESS UNIFIED SUPPORT TUBE (DUST) according to claim 20, wherein each of the rods contains an eyelet in a posterior position so that the wedges are retracted separately, in the event of actuation failure of the cam holder crown.

22. A DIVERLESS UNIFIED SUPPORT TUBE (DUST), comprising an upper cone, a guide tube, wedges responsible for riser traction support and a centralizer, the upper cone being automated and of a diverless style, wherein a top termination of a riser makes contact with the wedges in a lower part of the top termination, and wherein an automatic sliding mechanism of the wedges can replace a primary actuation in an automatic mechanism pull-in of a hydraulic system and ensure that the wedges are previously retracted, avoiding any contact with the top termination of the riser during the pull-in operation.

* * * * *